US005381668A

United States Patent [19]

Morioka

[11] Patent Number: 5,381,668

[45] Date of Patent: Jan. 17, 1995

[54] METHOD OF MAINTAINING ARTIFICIAL SNOW SURFACE

[75] Inventor: Koji Morioka, Amagasaki, Japan

[73] Assignee: Taikisha, Ltd., Tokyo, Japan

[21] Appl. No.: 796,081

[22] Filed: Nov. 20, 1991

[51] Int. Cl.[6] ..... F25B 25/02

[52] U.S. Cl. ..... 62/94; 62/235; 62/271

[58] Field of Search ..... 62/93, 94, 235, 271; 472/90

[56] References Cited

U.S. PATENT DOCUMENTS

| | | | |
|---|---|---|---|
| 3,119,239 | 1/1964 | Sylvan | 62/93 |
| 3,401,530 | 9/1968 | Meckler | 62/93 X |
| 3,890,797 | 6/1975 | Brown | 62/93 X |
| 4,345,439 | 8/1982 | Gundlach | 62/71 |
| 4,667,479 | 5/1987 | Doctor | 62/93 |
| 4,793,142 | 12/1988 | Bucceri | 62/74 |
| 4,914,923 | 4/1990 | Duplan et al. | 62/71 |
| 5,230,218 | 7/1993 | Clulow | 472/90 X |

*Primary Examiner*—William E. Tapolcai
*Attorney, Agent, or Firm*—Webb Ziesenheim Bruening Logsdon Orkin & Hanson

[57] ABSTRACT

A method of forming an artificial snow surface and an ice crusher machine used in the method are disclosed. Also disclosed is a method of maintaining a snow surface. The surface forming method has the steps of spraying water onto a floor incorporating a refrigerating unit; freezing the water by the refrigerating unit to form an ice layer on the floor; shaving a surface of the ice layer to generate artificial snow consisting of fine ice particles; and forming an artificial snow layer having an artificial snow surface by leaving the shaved snow on the remain of the ice layer in the course of the shaving step. The ice crushing machine has a self-propeling device for propelling the machine body on the ice layer while shaving the surface of the layer to produce fine ice particles behind the propelling path of the machine. The surface maintaining method has the step of dehumidifying air present adjacent the snow surface to avoid frosting of water content in the air on the surface.

4 Claims, 7 Drawing Sheets

METHOD OF MAINTAINING ARTIFICIAL SNOW SURFACE

BACKGROUND OF THE INVENTION

1. Field of the Invention

The present invention relates to a method of forming an artificial snow surface and an ice crusher machine used in the method. The invention also relates to a method of maintaining a snow surface.

2. Description of the Related Art

According to one conventional method (e.g. the Japanese laid-open utility model gazette No. 63-113866 and U.S. Pat. No. 2,676,471, to be hereinafter referred to as conventional method 1) of forming an artificial snow surface, water and compressed gas ( mainly, air ) both sufficiently refrigerated are sprayed through a nozzle, such that the sprayed mixture is frozen by adiabatic expansion at an atmosphere under the freezing point temperature to be formed into fine ice particles and then the ice particles are accumulated to form a snow surface.

According to another conventional method known from e.g. the Japenese published patent gazette No. 61-31393 (to be hereinafter referred to as the conventional method 2), ice cubes are prepared and these cubes are crushed by means of an ice crusher machine to be rendered into fine ice particles. Then, these particles are sprayed around to be accumulated for forming a snow surface.

According to a still further conventional method known from the Japanese laid-open patent gazette No. 56-133566 (to be hereinafter referred to as the conventional method 3), a weter-receiving bank as an ice-making bank is constructed along a skiing slope. Under a below-freezing point temperature, water is frozen on the ice-making bank to form an ice surface thereon. Then, this ice surface is crushed off by a crusher into fine ice particles and concurrently therewith the ice particles are scattered about onto the skiing slope beside the ice-making bank to form an artificial snow surface.

According to a further conventional method (to be hereinafter referred to as the conventional method 4), an ice layer is formed on a skiing slope by sprinking water under a below-freezing point temperature. Then, the formed ice layer is crushed by means of a roller equipped with a sieving machine driven on the layer to form the layer into fine ice particles.

The Japanese PCT-laid-open patent application No. 62-503118 (PCT/AU86/00158) discloses a still further method (to be hereinafter referred to as the conventional method 5). According to this method, mixture of water and surface-activating agent is stirred to foam. And, this foam is laid out on a skiing slope to be frozen at a below-freezing point temperature. Thereafter, a roller is driven on the frozen foam in order to crush it into ice particles forming a snow surface.

The above-identified PCT application discloses a further method (to be hereinafter referred to as the conventional method 6). According to this method, the above-described foam generated by stirring the mixture of the water and surface-activating agent is laid out on a flexible grating preliminarily refrigerated by a freezer unit, so that the foam is frozen in the grating. Thereafter, a roller is passed on the frozen foam to crush it into ice particles forming a snow surface.

The above-described conventional methods have drawbacks to be specifically described next.

The conventional method 1 has the significant shortcoming of requiring a great amount of energy for realizing and maintaining the below-freezing point atmosphere regardless of the current climate condition.

The conventional method 2 has the problem of requiring a great amount of labor and costs for the transport of the ice cubes separately prepared.

The conventional method 3 has the problem of requiring a significant amount of space for constructing the water-receiving surface along the skiing slope. The conventional method 4 suffers the problem that the roller often fails to pulvarize the ice layer into sufficiently small particles. Further, if a fine sieve is used to select fine, i.e. good ice particles alone, there will occur a great amount of waste of the unused particles. Conversely, if a rough sieve is used for the sake of economy, there will occur significant quality deterioration, i.e. roughness in the obtained ice particles.

With the conventional methods 5 and 6, the snow surface is formed by pulverizing the frozen foam by means of the roller. Accordingly, the resultant snow surface tends to be too compacted and hard which provides a skier with an uncomfortable and unnatural skiing feel, as compared with a snow surface formed by natural snow.

The conventional method 5 further suffers the same problem of the method 1, i.e. the problem of requring an enormous amount of energy for artificially creating the below-freezing point atmosphere regardless of the natural climate.

Taking the above-described states of the art into consideration, the primary object of the present invention is to provide the method of forming an artificial snow surface with such improvement as to achieve energy, cost and space economies and a snow surface of good quality. The second object of the present invention is to provide a method for effectively maintaining the snow surface formed by the above-described method of the invention. The third object of the present invention is to provide an ice crusher machine useful in the implementation of the invention's method of forming an artificial snow surface.

SUMMARY OF THE INVENTION

For accomplishing the above-noted object, a method of forming an artificial snow surface, according to the present invention, comprises the steps of:

- spraying water onto a floor incorporating a refrigerating means;
- freezing the water by said refrigerating means to form an ice layer on the floor;
- shaving a surface of said ice layer to generate artificial snow consisting of fine ice particles; and
- forming an artificial snow layer having an artificial snow surface by leaving the shaved snow on the remain of the ice layer in the course of said shaving step.

Functions and effects of the above-described method will be described next.

For forming on the floor an ice layer as a source for artificial snow, the sprayed water is directly refrigerated to freeze by means of the refrigerating means incorporated in the floor. Accordingly, the method can save energy required for freezing the sprayed water, as compared with the conventional methods 1, 3, 4 and 5 which freeze the sprayed water or foam by way of the atmosphere whose temperature forcibly controlled below the freezing point by refrigerating a great amount of ambience air.

Further, the ice layer as the snow source is directly formed by refrigerating the water sprayed on the floor where the ice layer is to be formed. This is advantageous for significantly saving the labor and costs required for transporting the ice cubes as the snow source from its factory to the final destination which is the case with the conventional method 2. Further, in comparison with the conventional method 3 where the ice-making bank has to be installed along the entire great length of the skiing slope where the artificial snow is to be spread, the method of the present invention can eliminate the space required solely for installing the ice-making bank, since the snow surface per se is utilized as the ice-making surface. Thus, the method of the present invention consequently achieves significant installment space ecomony.

Regarding the quality of obtained artificial snow, according to the invention's method, the artificial snow is generated by shaving the surface of the ice layer and the shaved ice is left on the remain of the ice layer, such that the invention's method can provide snow with finer and better quality, when compared with the conventional method 4 where the roller is used for crushing the ice layer. Further, there occurs no waste in the use of the snow-source ice, and the method can provide good-quality snow in a constant and stable manner. Moreover, when compared with the conventional methods 5 and 6 where the snow is formed by crushing frozen foam by means of a roller, the artificial snow obtained by the present invention will have fine and good quality almost as good and fine as natural snow.

Consequently, the invention has achieved its intended object of providing the method of forming an artificial snow surface with such improvement as to achieve energy, cost and space economies and a snow surface of good quality.

A method of maintaining the artificial snow surface obtained in the above-described manner, according to the present invention, is characterized by the step of:

dehumidifying ambient air present adjacent above the snow surface in order to present water content in the ambient air from frosting.

Functions and effects of this method will be described next.

In conditioning the ambience air present adjacent above the snow surface, the method prevents frosting of the air on the snow surface (i.e. transfer of the heat from the air to the snow, such that the method can prevent also disadvantageous increase in the load in the refrigeration of the snow surface. Especially, the refrigerating machine inevitably suffers low operation efficiency in refrigerating the snow surface because the machine has to provide a very low temperature for this purpose. Therefore, such effective prevention of increase in the load can achieve significant reduction in the running cost of the system.

According to one preferred embodiment of the present invention, an adsorption type dehumidifying device is used as the dehumidifying means.

When the adsorption type humidifying device is used, there occurs increase in the temperature of the processed air in association with its dehumidifying operation. This temperature increase can be effectively utilized for preventing excessive refrigeration of the snow surface due to absorption of heat from the ambience air, which tends to occur during the winter season. Such excessive refrigeration of the snow surface will result in deterioration in the quality of the snow. Then, the prevention of excessive refrigeration can provide the skier with comfortable and smooth skiing feel.

Further, a cooling type dehumidifying device can be also used as the dehumidifying means.

When this cooling type dehumidifying device is used, there occurs decrease of the temperature in the processed air. Accordingly, the device can effectively restrict transfer of the heat from the ambience air to the snow surfaces which heat transfer often occurs during the summer season. Thus, in this case too, the snow surface can be maintained at good skiing condition through the prevention of frosting of water content present in the ambience air on the snow surfaces and further much energy can be saved through prevention of melting of the snow.

In combination of the above two cases, it is also conceivable to selectively employ the adsorption type dehumidifying device when the ambience air is at a relatively low temperature and to use the cooling type dehumidifying device when the air is at a relatively high temperature.

With this arrangements the use of the adsorption type dehumidifying device provides the advantage of restricting excessive refrigeration of the snow surface during the winter season while the use of the cooling type dehumidifying device provides the advantage of restricting the heat transfer from the ambience air to the snow surface during a warm season. Thus, such selective use between the two types of dehumidifying devices can achieve both the comfortable skiing feel and the running cost reduction.

Further, it is conceivable to control the humidyfing means so as to equate a vopor pressure of the snow surface with a vopor pressure of the ambience With this further arrangement, it becomes possible to avoid frosting phenomenon on the snow surface which would otherwise occur when the vapor pressure of the ambience air is higher than that of the snow surface. In this manner, through the prevention of frosting on the snow surface as well as of water-vaporization from the snow surface both of which impair smoothness of the snow surface, the snow surface can be maintained at a good skiing condition more reliably and effectively.

In particular, when the snow surface is generated by forming a snow layer containing solid particles of e.g. resin material, with such water-vaporization from the snow surface, the deterioration in the smoothness of the snow surface takes place very significantly, since the soild particles become exposed on the surface to the ambience. Accordingly, the above-described prevention of water-vaporization from the snow surface will be very much appreciated in such case.

An ice crushing machine usuable for forming an artificial snow surface, according to the present invention, comprises:

a propelling means for propelling a machine body on an ice layer or an artificial snow surface; and a shaving blade attached to the machine body for shaving a surface of said ice layer.

Functions and effects of the features will be described next.

According to the above-defined characterizing features of the present invention, as the machine body is propelled by the propelling means on the ice layer or the artifical snow surface, the shaving blade mounted on the machine body shaves the surface of the ice layer to render it into fine ice particles forming artificial snow. As the propelling machine leaves behind the shaved snow particles on the remain, i.e. unshaved portion, of the ice layer, the machine can form an artificial snow surface of a desired area on the ice layer.

With use of this ice crushing machine, the aforedescribed method of the present invention can be conducted very easily and efficiently.

Preferably, the shaving blade has its shaving edge oriented along the thickness of the ice layer.

This preferred arrangement renders the propelling direction of the machine body normal to the shaving direction of the shaving blade, thus enabling the propelling operation and the shaving operation of the machine to be functionally independent of each other. That is, these operations can take place without one being adversely affected by the other.

Further, it is conceivable to arrange the shaving blade to effect the shaving in a direction slanted relative to the thickness direction of the ice layer. As compared with an arrangment where the shaving edge of the blade is placed in parallel with the suface of the ice layer, the slanted blade edge arrangement has the advantage that the cutting depth gradually increases adjacent a lower end thereof so that a larger amount of artificial snow can be generated.

Still further, the shaving blade can have its shaving edge oriented substantially normal to the direction of the thickness of the ice layer.

With this further arrangement, through the substantial agreement between the propelling direction of the machine body and the shaving direction of the blade, it becomes possible to effectively utilize a portion of the propelling force of the machine body for the shaving operation. Thus, in this case too, a large amount of artificial snow can be efficiently generated through the movement of the mechine body on the ice layer.

Further, and other objects, features and effects of the invention will become more apparent from the following more detailed description of the embodiments of the invention with reference to the accompanying drawings.

BRIEF DESCRIPTION OF THE DRAWINGS

FIGS. 1 through 5 illustrate one preferred embodiment of the present invention; in which, FIG. 1 is a view showing a construction of a system of an indoor artificianl skiing slope, FIG. 2 is a partially cutaway plane view of an ice crushing machine, FIG. 3 is a front section of the ice crushing machine, FIGS. 4 and 5 illustrate an ice crushing machine relating to a further embodiment of the present invention, with FIG. 4 being a partially cutaway plane view and FIG. 5 being a front section of the machine, respectively.

DESCRIPTION OF THE PREFERRED EMBODIMENTS

Preferred embodiments of the present invention will now be described in details with reference to the accompanying drawings.

Figure 1:
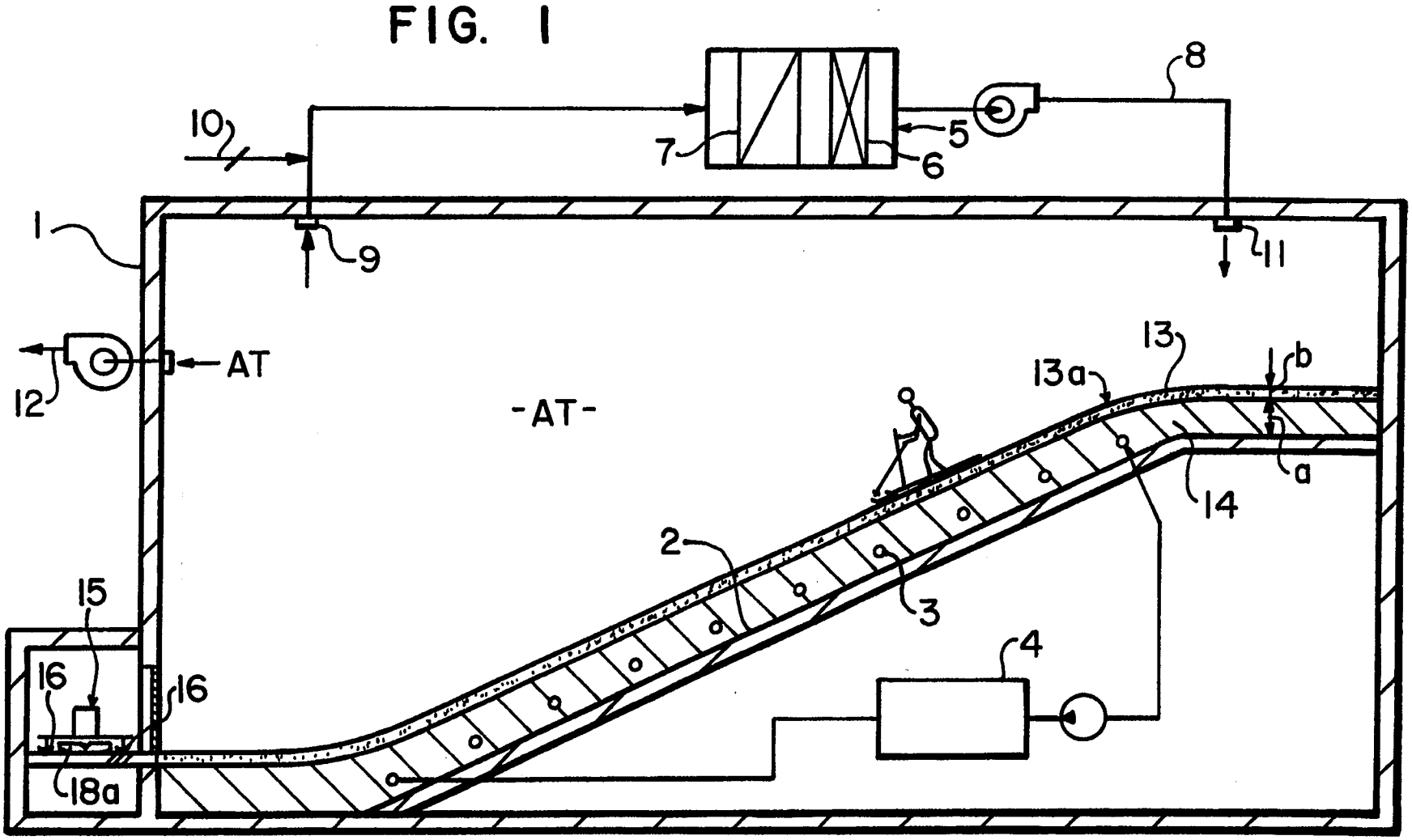

FIG. 1 shows a construction of an indoor skiing slope. Reference numeral 1 denotes a housing. Numeral 2 denotes a sloped floor incorporating a heat insulating means. Numeral 3 denotes a refrigerating-medium pipe embedded substantially over the entire surface of the sloped floor 2. Numeral 4 denotes a refrigerating machine for refrigerating a refrigerating medium (brine) to e.g. −14 to −22 degrees in Celsius. Numeral 5 denotes an airconditioner. Numeral 8 denotes a cooling coil (for circulating cooling water at +5 to +7 degrees in Celsius. Numeral 7 denotes a dehumidifying unit incorporated in the air-conditioner 5. Numeral 8 denotes an air passage for combining an indoor air AT introduced through an air intake opening 9 with an outdoor air introduced an outdoor-air flow passage 10 and introducing this combined air into the air-conditioner 5 and then feeding the conditioned air into the ineterior of the housing through an air outlet opening 11. Numeral 12 denotes an air exhaust passage for exhausting the indoor air AT by an amount corresponding to the amount of the introduced outdoor air.

For forming a snow surface 13*a*, an appropriate amount of water is sprayed over an entire surface of the sloped floor 2. Then, the sprayed water is frozen by the refrigerating-medium pipe 3. These operations are repeated to form a multiplicity of thin ice layers on the sloped floor 2 until an ice layer 14 having a predetermined thickness (a) is obtained.

The amount of the water sprayed at one time should be so controlled that the water will immediately freeze on the sloped floor 2 without falling off the floor.

Further, the predetermined thickness (a) of the ice layer 14 preferably ranges between 100 and 150 mm.

After the formation of the ice layer 14, a self-propelling type ice crusher machine 15 is driven on the entire surface of the ice layer 14. As the machine 15 being propelled, the machine 15 shaves a surface of the ice layer 14 to generate artificial snow consisting of fine ice particles. At the same time, as the propelling machine 15 leaves behind the generated artificial snow on the remain of the ice layer 14, an artificial snow layer 13 is formed on the ice layer 14, such that these layers 13 and 14 together form the snow surface 13*a*.

The dimension of the particle of the artificial snow can be varied through adjustment of a shaving depth of a rotary shaving blade 18*a* relative to the ice layer 14, in order to obtain such snow particle as most suitable for skiing.

Depending on the necessity, the ice crusher machine 15 is driven on the ice layer 14 or on the formed snow layer 13 while shaving the surface thereof for a plurality of times. With these repeated operations, the snow layer 13 gradually increases in its thickenss (here, the aforementioned snow surface denotes such layer having its air content increased due to the transformation of the ice into the fine particles in comparison with the ice layer 14).

The thickness (b) of the snow layer 13 preferably ranges between 20 and 50 mm.

Incidentally, it is conceivable to mix a surface-activating agent or a water-swelling material in the water to form the ice layer 14 for the purpose of facilitating the generation of the aritificial snow by shaving the ice layer. However, with such mixing material, there occurs reduction in the heat transmission ratio of the ice layer 14, which results in decrease in the refrigerating temperature necessary for the refrigerating-medium pipe 3 to prevent melting of the snow layer 13 on the ice layer 14. For this reason, there will inevitably occur increase in the device costs as well as in the running costs, in addition to the cost of the mixing material per se.

Accordingly, it is more economically advantageous if water without such additive is used as the water to be sprayed for the formation of the ice layer 14

If such additive is to be used, such material should be selected as is inexpensive and as will cause only minimal reduction in the heat transmitting ratio in the ice layer 14. Alternately, such reduction in the heat transmission ratio can be restricted by employing an additive consisting of very small particles to reduce the amount of the air present in the ice layer 14.

The formation of the ice layer 14 and the prevention of melting of the ice layer 14 and the snow layer 13 are effected by means of refrigeration via the refrigerating-medium pipe 3 as described above. In this connection, if the ambience temperature (i.e. the outdoor air in this embodiment) is relatively high and a large amount of heat can enter the housing (mainly during the summer season), a cooling coil 6 is operated to cool the indoor air to provide skiers with comfortable atmosphere as well as to help the refrigerating-medium pipe 3 to prevent melting of the snow surface 13*a*.

In conditioning the indoor air AT, in addition to the cooling of the air AT by means of the cooling coil 6 when the ambient temperature is high, because the indoor air AT becomes moist by the breaths of the skiers and by the introduction of new outdoor air, the dehumidifying unit 7 is operated to dehumidify the moisted indoor air AT so as to maintain the dew point of the indoor air AT below the temperature of the snow surface 13*a* ranging between −2 and −3 degrees in Celsius thereby to maintain good skiing condition of the snow surface 13*a*.

Figure 2:
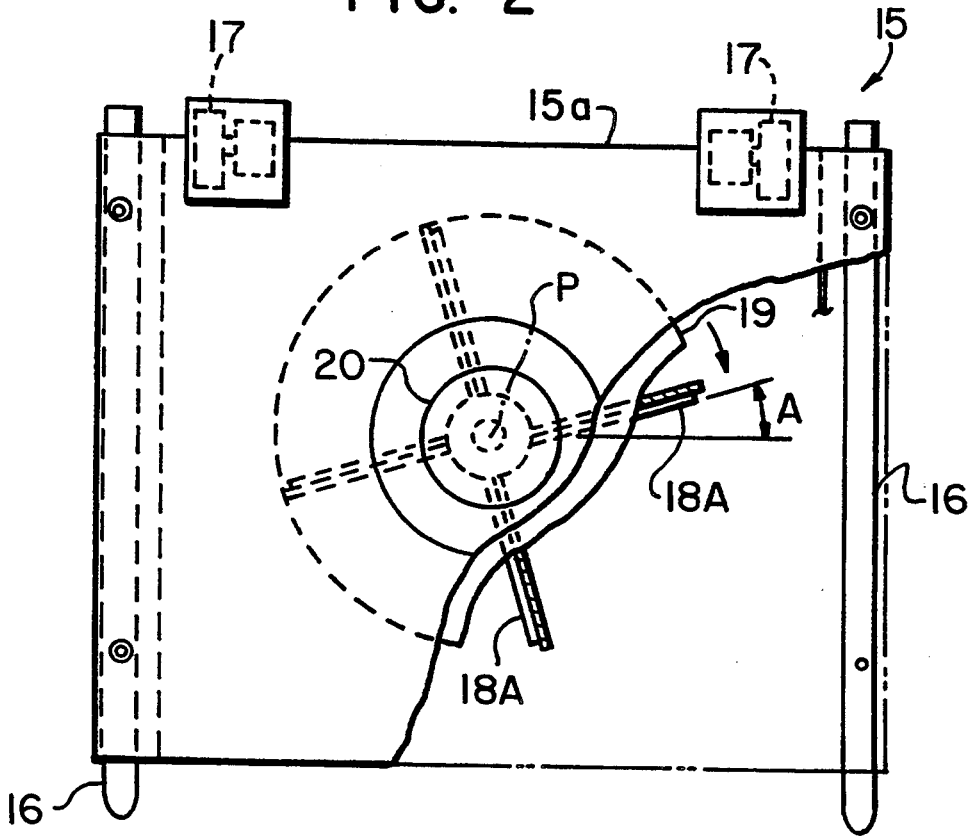
Figure 3:
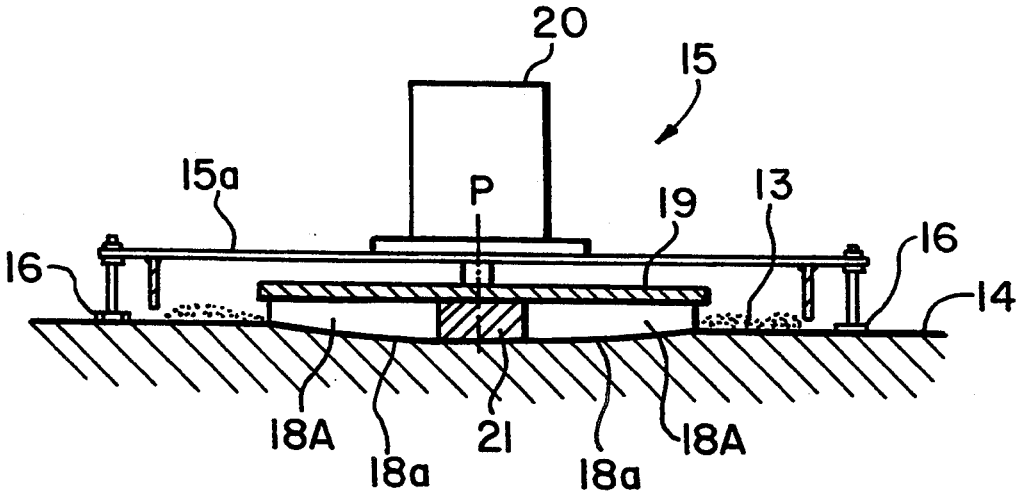
Figure 11:
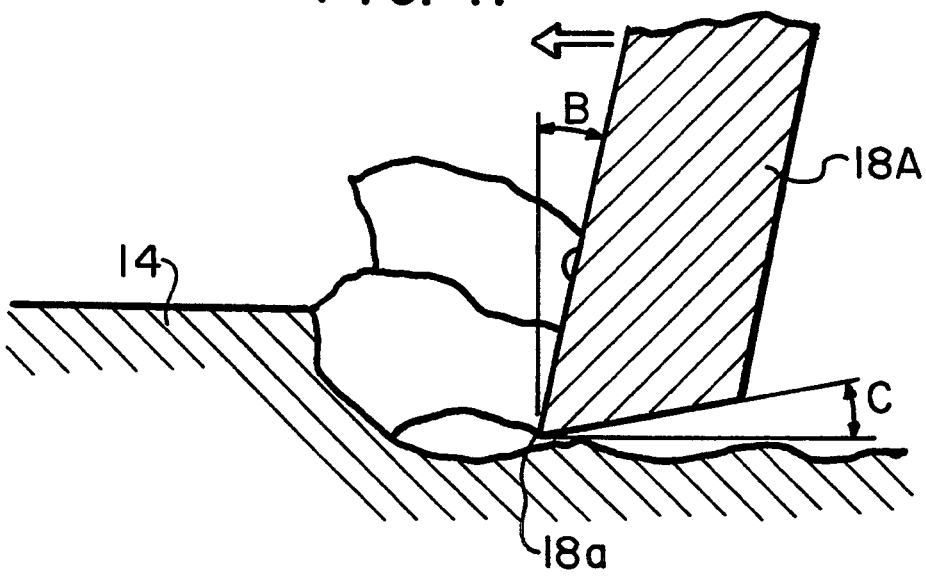
FIG. 11 is an enlarged section of a shaving blade.

The construction of the ice crusher machine 15 will be particularly described with reference to FIGS. 2 and 11.

The machine 15 includes a machine body 15*a* mounting a pair of right and left sledges 16 and a pair of right and left propelling wheels 17 as a propelling means for propelling the machine body 15*a* on the ice layer 14 or the snow surface 13*a*. This propelling means need not be mounted to the machine body 15*a*. Instead, it is conceivable to propel the machine body 15*a* by means of a separate propelling means. Further, to a lower portion of the machine body 15*a*, there are attached rotary shaving blades 18A as a blade means for shaving the surface of the snow surface 14.

The propelling wheels 17 serve to propel the machine body 15*a* straightway when these wheels 17 are rotated at a same speed in a same direction. Also, when these wheels 17 are rotated at different speeds or directions, these wheels 17 serve to steer the machine body 15*a*.

The plurality of shaving blades 18A are arranged in a radial pattern on a lower face of a rotary disc rotatable about a vertical axis P extending substantially normal to the ice layer 14. As these blades 18A are driven to rotate via the rotary disc 19 by a motor 20, the rotating blades 18A shave or cut the surface of the ice layer 14 by a certain depth and the cut ice as artificial snow is sent radially outwards to be left on the remain of the ice layer 14.

A blade edge 18*a* formed at a lower edge of each shaving blade 18A is inclined with an outer portion thereof relative to the radius of the rotary disc 19 being formed higher than an inner portion, such that the blade edge 18*a* when used shaves the ice layer 14 with an inclination relative to the direction of the thickenss of this ice layer 14. With this arrangement in operation, the inclined blade edges 18*a* cut deeper at the lower sides thereof. As a result, the blade edges 18*a* can cut deep with one shaving action thereby to efficiently generate a large amount of artificial snow, Incidentally, the angle (A) of the inclination (i.e. the inclination angle provided for smooth sending of the generated artificial snow outwards relative to the radius of the rotary disc 19) between the radius of the rotary disc 19 and the shaving blade 18A preferably ranges between 15 and 15 degrees. Further, the scooping angle (B) of the shaving blade 18A preferably ranges between 20 and 40 degrees. The clearance angle (C) of the shaving blade 18A preferably ranges between 5 and 10 degrees.

The shaving blades 18A are replaceable when necessary. Also, at a center of the radial pattern arrangement of the shaving blades 18A, there is attached a cylinder member 21 for preventing intrusion and resultant clogging of the generated artificial snow.

The rotation speed of the rotary disc 19 is adjustable by an inverter control on the motor 20. Through this adjustment of the rotation speed, the quality of the artificial snow is adjusted.

Figure 12:
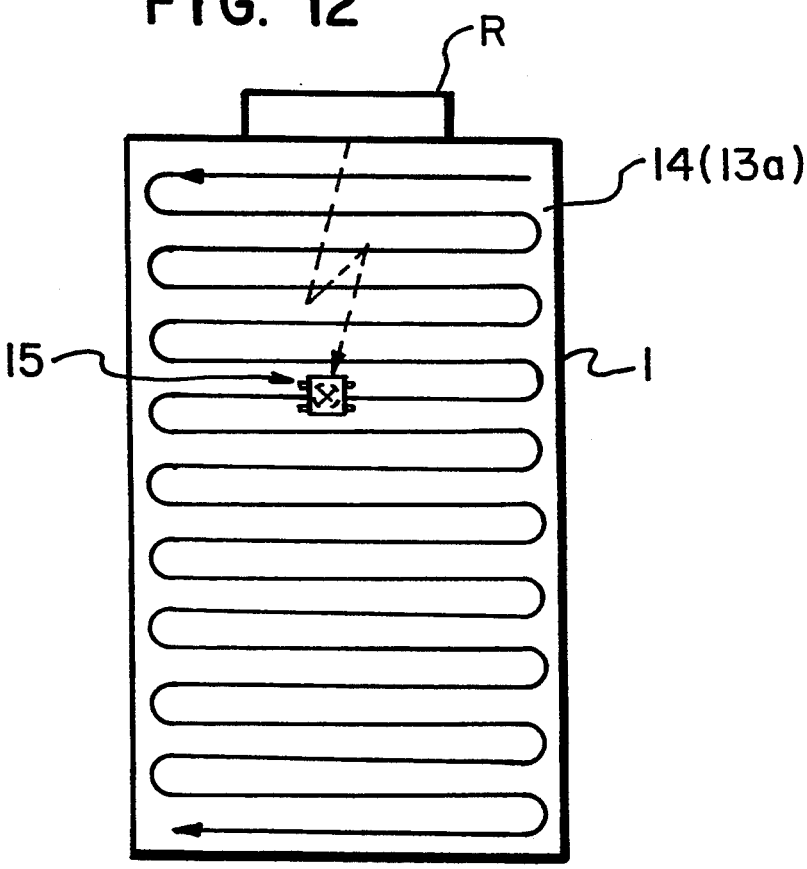
FIG. 12 is a plane view illustrating an operation of the crushing machine.

The above-described ice crusher machine 15, as shown in FIG. 12, is operated by a wireless remote control operation effected from an indoor monitor room R. By this remote control operation, the shaving blades 18A are driven at a predetermined speed to shave the surface of the ice layer 14 while the machine 15 is propelled at a predetermined propelling speed over the entire surface of the ice layer 14 or the snow surface 13*a*, thereby to form a large area of the snow layer 13 having a predetermined thickenss (b) which consequently forms the snow surface 13*a* (i.e. skiing slope).

Some other embodiments of the invention will be specifically described next.

(a) The refrigerating means incorporated in the floor 2 is not limited to the brine refrigerating-medium pipe 3, Various other types of refrigerating systems can be employed. For instance, it is conceivable to employ such refrigerating system as freezes and prevents melting of the snow surface 13*a* by refrigerating the air immediately above the snow surface 13*a*.

(b) As mentioned hereinbefore, the water to be sprayed over the floor 2 to form the ice layer 14 thereon can contain various kids of additives depending on the convenience.

(c) The ice crusher machine for shaving the surface of the ice layer 14 to form the artificial snow consisting of fine ice particles is not limited to the self-propelling type ice crusher machine 15 disclosed in the foregoing embodiment. It is possible to employ other types of machines, one of which will be particularly described later.

(d) The invention's method of forming an artificial snow surface can be used also for forming an artificial snow surface outdoors.

(e) The snow surface 13*a* to be formed by the method of the invention is not limited to the above-described snow surface sloped in one direction. Instead, it is also possible to form a snow surface with many ups and downs for use in the practice of the Nordic type skiing or a flat snow surface.

(f) With respect to the construction of the ice crusher machine of the invention, the foregoing embodiment dislcoses the propelling means for propelling the machine body 15*a* comprised of the combination of the sledges 16 and the propelling wheels 17. Instead, the propelling means can be a crawler type propelling device. Further, the machine can be of a manually propelled type instead of the self-propelled type disclosed in the foregoing embodiment.

(g) In the ice crusher machine, the shaving blades for shaving the surface of the ice layer 14 can be of various types to be described next.

Figure 4:
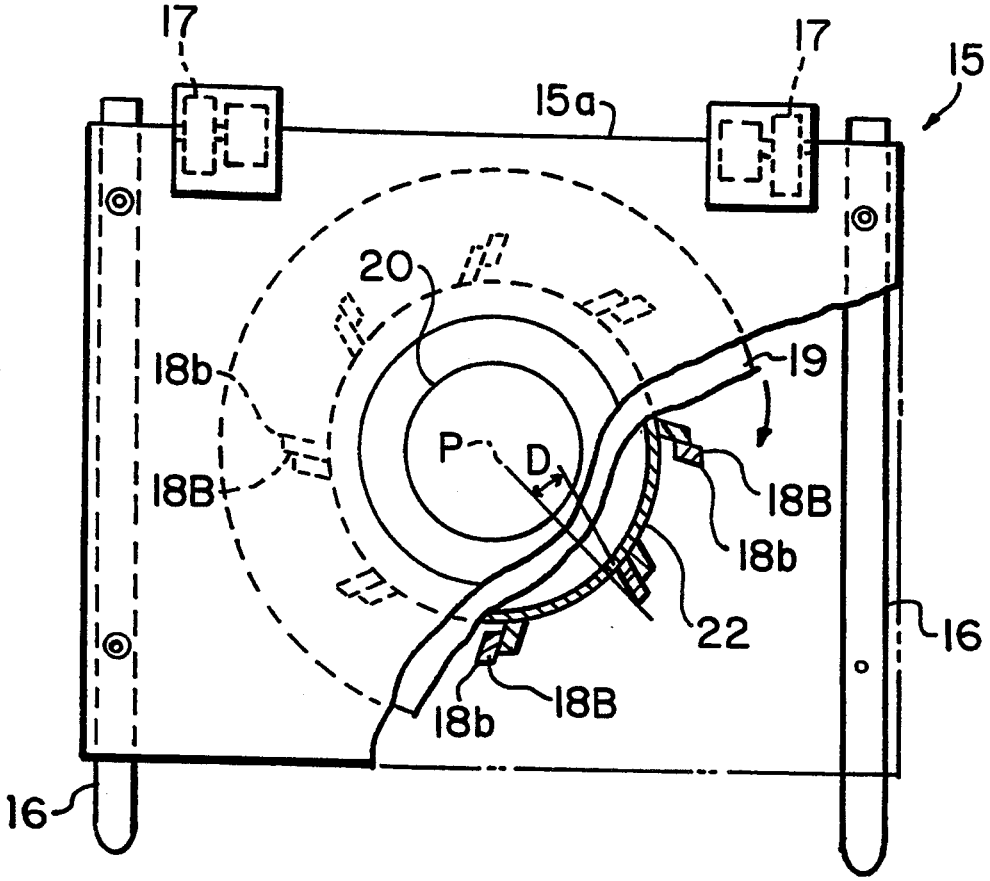
Figure 5:
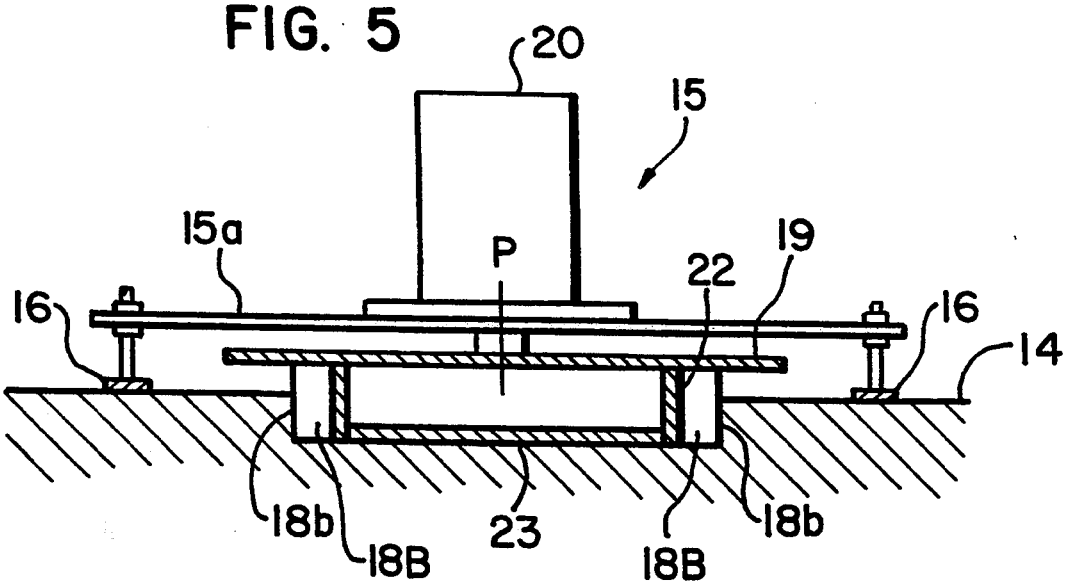

(i) As shown in FIGS. 4 and 5, a cylinder member 22 is coaxially attached to the lower face of the rotary disc 19 which is similar to the one used in the foregoing embodiment. On an outer periphery of this cylinder member 22, there are attached a plurality of shaving blades 18B having blade edges 18*b* extending outwards along the radius of the disc 19. The motor 20 is used for rotating the rotary disc 19 so that the blades 18B cut the ice layer 14 in the direction normal to the direction of the thickness of the layer 14 (i.e. the direction in parallel with the propelling direction of the machine body 15*a*). Further, with this shaving, the generated artificial snow is sent outwards relative to the radius of the rotary disc 19 to be left on the ice layer 14.

A reference numeral 23 denotes a bottom plate for closing a lower terminal end of the cylinder member 22 for preventing intrusion and resultant clogging of the generated artificial snow in the member 22.

In the above-described construction of this further embodiment, the scooping angle (D) of the shaving blade 18B preferably ranges between 20 and 40 degrees.

Figure 6:
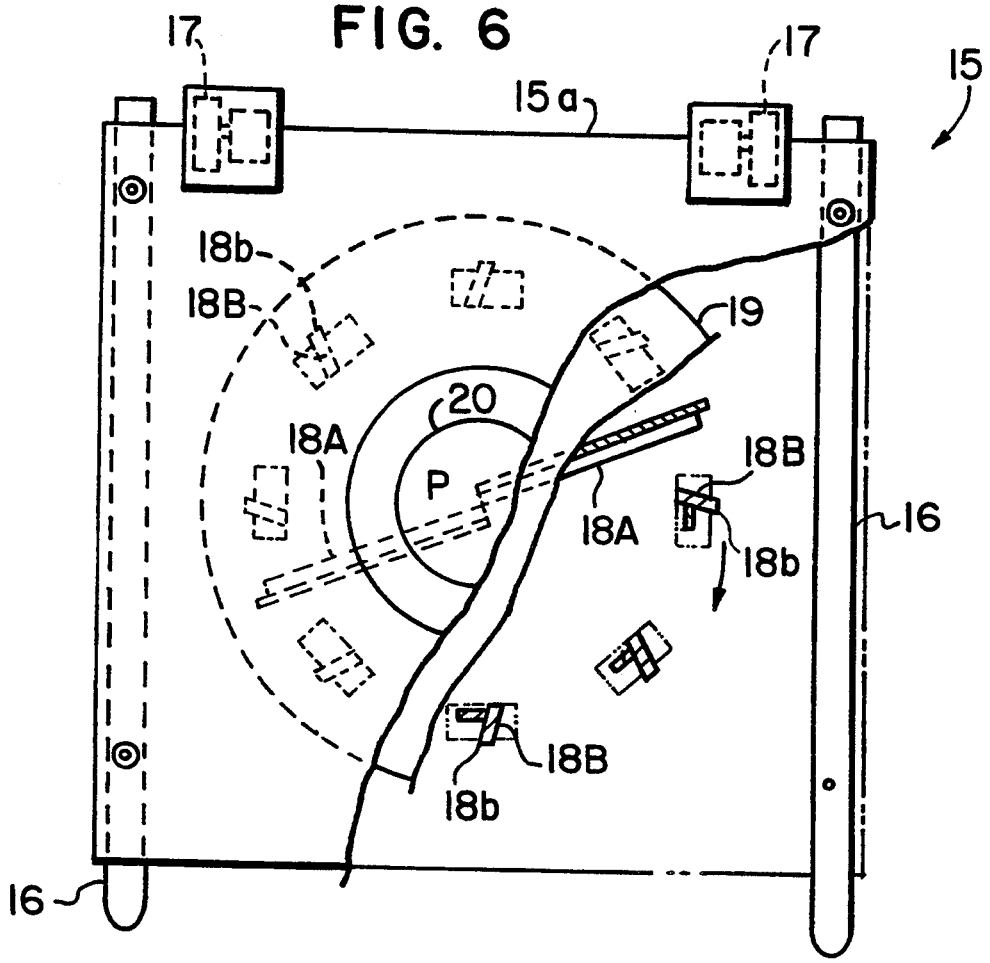
FIGS. 6 and 7 illustrate an ice crushing machine relating to a still further embodiment of the present invention, with FIG. 6 being a partially cutaway plane view and FIG. 5 being a front section of the machine, respectively.
Figure 7:
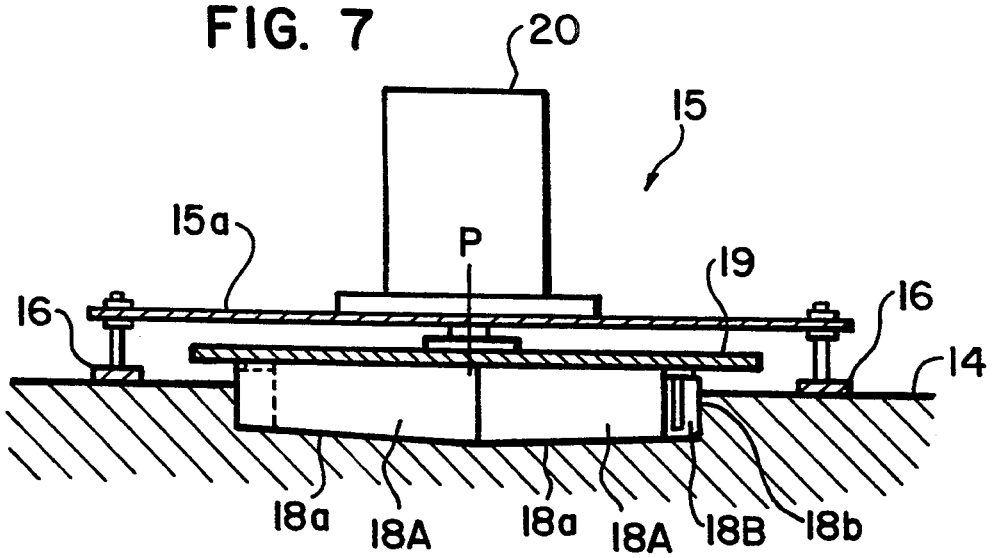

(ii) As shown in FIGS. 6 and 7, as auxiliary shaving blades, a pair of shaving blades 18A (substantially the same as those in the first embodiment) having downwardly oriented blade edges 18*a* are attached with 180 degree displacement therebetween to the lower face of the rotary disc 19. In addition, as main shaving blades, a plurality of shaving blades 18B having shaving edges 18*b* extending radially outwards are attached to the lower face of the rotary disc 19 adjacent the outer periphery of the disc 19. In operation, as the auxiliary shaving blades 18A cut the ice layer 14 along its thickness to support sinking movements of the main blades 18B into the surface of the ice layer 14, the main blades 18B cut the ice layer 14 in the direction normal to the thickness direction of the layer 14 (i.e. in parallel with the propelling direction of the machine body 15*a*). In association with the shaving actions of the blades, the generated artificial snow is sent outwards (i.e. rearwardly of the machine body 15*a* relative to the propelling direction of the machine body 15*a*) to be left on the remain of the ice layer 14.

Figure 8:
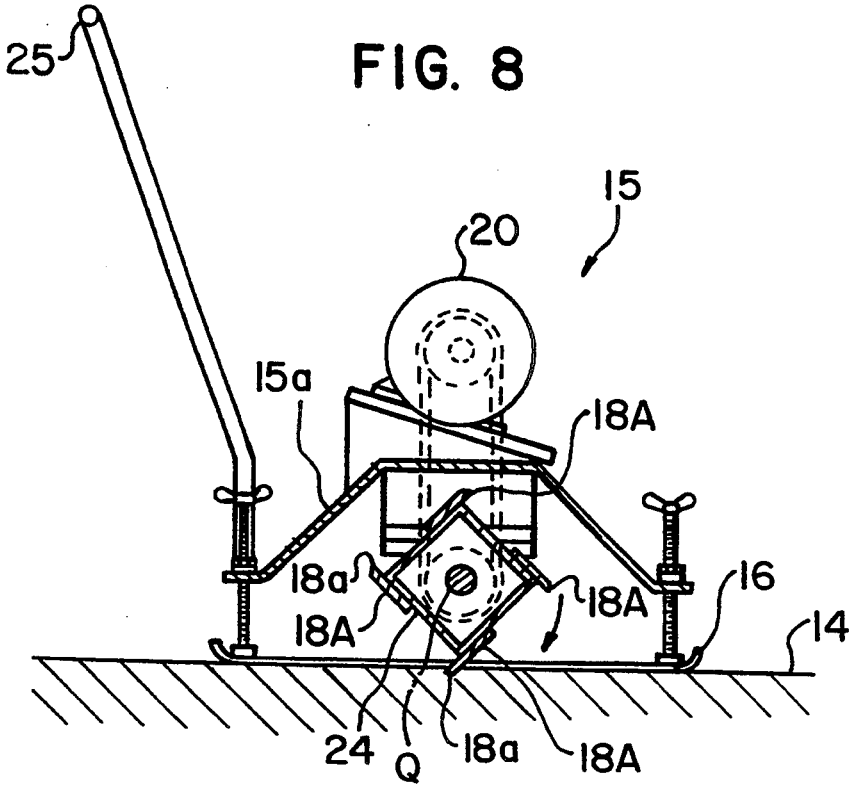
FIGS. 8 and 9 illustrate an ice crushing machine relating to a still further embodiment of the present invention, with FIG. 8 being a side section and FIG. 9 being a front section of the machine of this embodiment, respectively.
Figure 9:
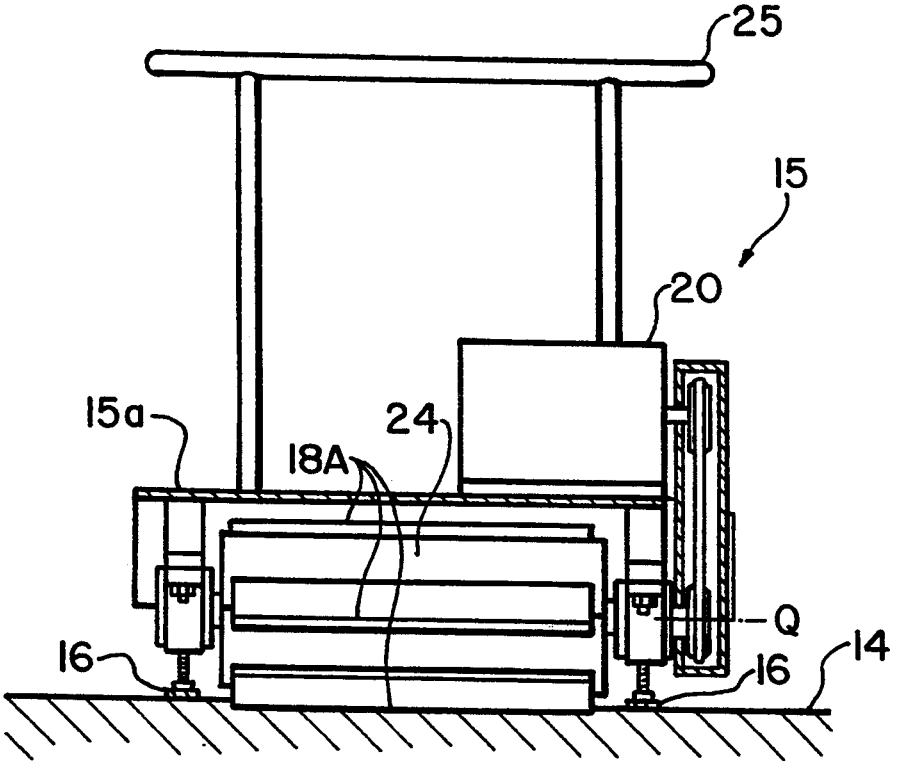

(iii) As shown in FIGS. 8 and 9, the plurality of shaving blades 18A are attached to a rotary drum 24 rotatable about an axis Q extending substantially in parallel with the ice layer 14, so that the blades 18A rotate about the axis Q to shave the surface of the ice layer 14.

A reference numeral 25 denotes a handle for an operator.

(h) A further embodiment of the invention's method of maintaing the snow surface will be particularly described next.

Figure 10:
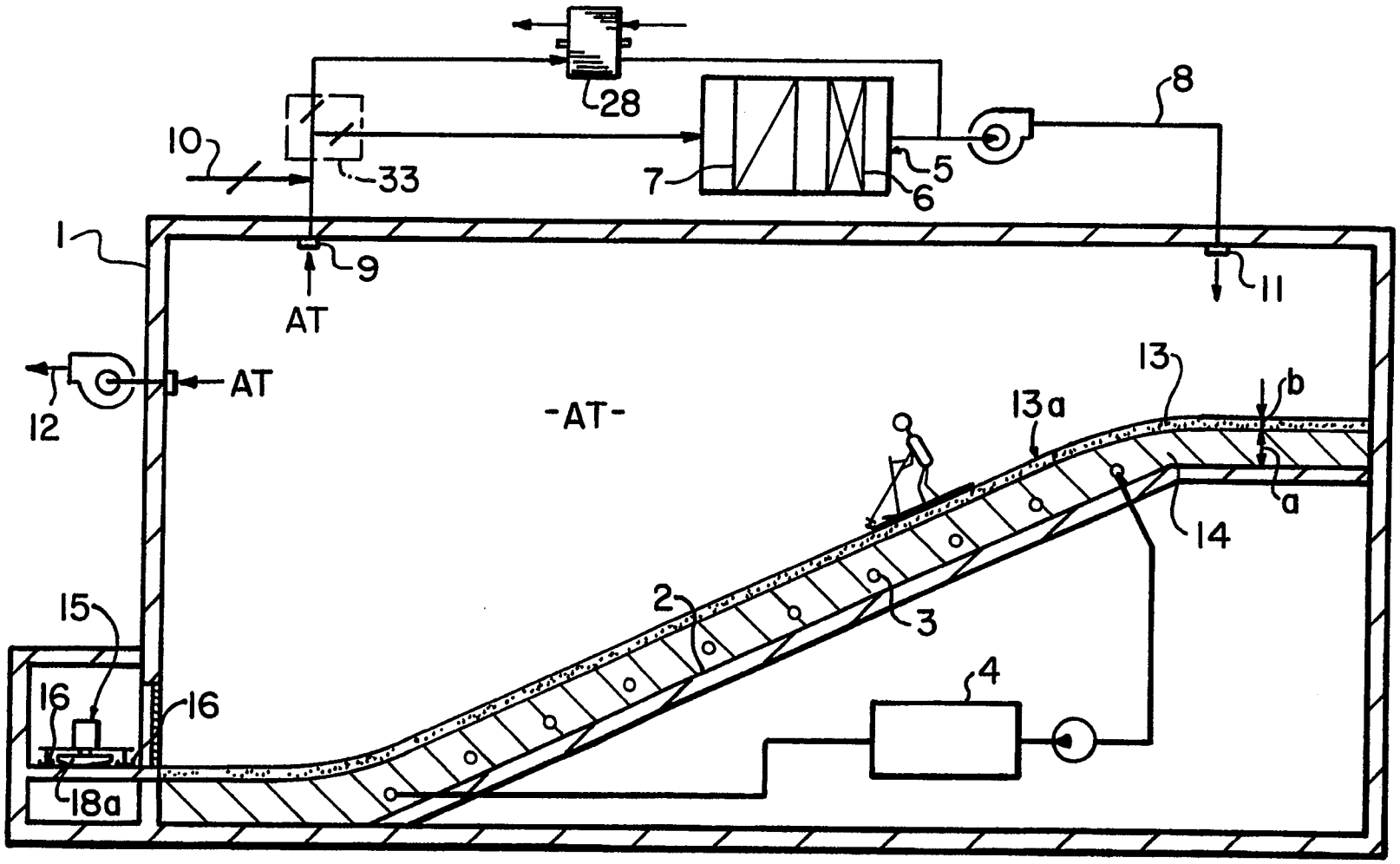
FIG. 10 is a view illustrating a system relating to a still further embodiment of the present invention.

As shown in FIG. 10, the system includes an adsorption type dehumidifying unit 28 and a damper mechanism 33 for selectively providing two conditions, i.e. a condition for causing the combined air comprised of the indoor air AT introduced through the air intake opening 10 and the outdoor air to pass through the air-conditioner 5 and a further condition for causing the combined air to pass through the dehumidifying unit 28.

Melting of the snow surface 13*a* is restricted by maintaining the snow surface 13*a* at a predetermined low temperature (ts) (e.g. −2 to −3 degrees in Celsius) throughout the year through the refrigeration by the refrigerating-medium pipe 3 on the ice layer 14 and the snow layer 13. With this, the snow surface 13*a* can be maintained at a good skiing condition. Further, if the ambience temperature (the outdoor temperature in the present case) is relatively high and a large amount of heat tends to enter the building interior (mainly in the summer season), the cooling coil 6 is operated with the damper mechanism 33 being switched over for the air passage through air-conditioner 5, thereby to provide comfortable indoor atmosphere for the skiers and also to restrict melting of the snow surface 13*a* in cooperation with the refrigeration by the refrigerating-medium pipe 3.

In conditioning the indoor air AT, in addition to the cooling of the air AT by means of the cooling coil 6 when the ambient temperature is high, because the indoor air AT becomes moist by the breaths of the skiers and by the introduction of new outdoor air, with the damper mechanism 33 switched over for the air passage through the air-conditioner 5, the cooling type dehumidifying unit 7 is operated to dehumidify the moisted indoor air AT. Alternately, the adsorption type dehumidifying unit 28 is operated with the damper mechanism 33 being switched over for the air passage through this unit 28. In either case, the operation is effected so as to maintain the dew point (tp) of the indoor air AT below the temperature (ts) of the snow surface 13*a* (i.e. to maintain the condition: $tp \leqq ts$, in other words, to maintain the vapor pressure of the indoor air AT lower than the vapor pressure of the snow surface 13*a*), thereby to avoid frosting of the moist on the snow surface 13*a* consequently to maintain a good skiing condition of the snow surface 13*a*.

The selective uses of the cooling type dehumidifying unit 7 and the adsorption type dehumidifying unit 28 will be particularly described next.

The cooling type dehumidifying unit 7 operable to cool the processed air while dehumidifying it is used when the ambience temperature is high and a large amount of heat tends to enter the building interior (mainly during the summer season), so that the cooled and dehumidified air is effectively used for maintaining comfortable indoor atmosphere by restricting intrusion of the heat into the interior. Further, this type of dehumidifying unit is used also for restricting transfer of the heat from the indoor air At to the snow surface 13*a* thus aiding the prevention of melting of the snow surface 13*a*.

Incidentally, in the operation of the air-conditioner 5, on some occasions, both the cooling type dehumidifying unit 7 and the cooling coil 6 are operated; and on other occasions, only one of these is operated, depending on the particular temperature load and humidity load present.

In contrast to the above-described cooling type dehumidifying unit 7, the adsorption type dehumidifying unit 28 in which there occurs increase in the processed air in association with the dehumidifying operation is used when the ambience temperature is low (mainly during the winter season) so as to effectively utilize the air temperature rise associated with the dehumidifying operation for restricting excessive reduction in the indoor air temperature thereby to maintain comfortable indoor atmosphere.

Refering more particularly to the dehumidifying operation, in this dehumidifying operation by either the cooling type dehumidfying unit 7 or the adsorption type dehumidifying unit 28, the unit is so controlled as to equate the vapor pressure of the snow surface 13*a* with the vapor pressure of the indoor air AT. With this further arrangement, it becomes possible to restrict both frosting on the snow surface and water-vaporization from the snow surface which impair smoothness of the snow surface.

Another unillustrated refrigerating machine than the refrigerating machine 4 is connected to the cooling coil 6 of the air-conditioner 5. More particularly, the use of the aforementioned refrigerating machine 4 which does no have a good coefficient of performance because of the requirement for producing a very low temperature for preventing of melting of the ice layer 14 and the snow layer 13 is limited for this purpose of refrigerating the ice layer 14 and the snow layer 13, so that this refrigerating machine 4 can be of a relatively small capacity to save energy consumption.

(i) As the dehumidifying means, only either the cooling type dehumidifying unit or the adsorption type dehumidifying unit can be employed. Further alternately, any other type of dehumidifying unit can be used.

(j) Instead of dehumidifying the entirety of the indoor air AT as described in the foregoing embodiments, it is also conceivable to dehumidify only a portion of the air present within an appropriate altitude range from the snow surface 13*a*.

(k) The snow surface 13*a* can be formed of the artificial snow generated by the various methods described hereinbefore and can also be formed of natural snow.

(l) The use of the snow surface formed by the method of the present invention is not limited to the use of skiing. The surface can be used for any other application.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of maintaining a snow surface in a housing having indoor air therein, with said housing surrounded by outdoor air, said method comprising the steps of:

dehumidifying said indoor air above said snow surface by means of a dehumidifying means, said dehumidifying means including a cooling type dehumidifying unit and an adsorption type dehumidifying unit;

selecting for said dehumidifying step said cooling type dehumidifying unit when the temperature of said outdoor air is relatively high and said adsorption type dehumidifying unit when the temperature of said outdoor air is relatively low; and adjusting said dehumidifying means to maintain a water vapor pressure of said indoor air at a value substantially equal to a water vapor pressure at said snow surface to restrict frosting of water content present in said indoor air on said snow surface thereby to maintain said snow surface in a good skiing condition.

2. The method as claimed in claim 1, wherein said dehumidifying means is adjusted to maintain the water vapor pressure of said indoor air below the water vapor pressure at said snow surface.

3. The method as claimed in claim 1, further including the steps of combining said indoor air with said outdoor air to form combined air and passing said combined air through said selected dehumidifying unit.

4. The method as claimed in claim 3, wherein said step of selecting said dehumidifying unit is carried out by a dumper mechanism which can be operated to direct said combined air to said cooling type dehumidifying unit or to said adsorption type dehumidifying unit.

* * * * *